US005382196A

United States Patent [19]

Lodrick

[11] Patent Number: 5,382,196

[45] Date of Patent: Jan. 17, 1995

[54] PERSONAL CUE CHALK HOLDER

[76] Inventor: Lester B. Lodrick, 603 E. Meyers, Hazel Park, Mich. 48030

[21] Appl. No.: 105,473

[22] Filed: Aug. 12, 1993

Related U.S. Application Data

[63] Continuation of Ser. No. 898,310, Jun. 15, 1992, abandoned.

[51] Int. Cl.[6] ..... A63D 15/16

[52] U.S. Cl. ..... 473/38

[58] Field of Search ..... 473/36, 37, 38, 39

[56] References Cited

U.S. PATENT DOCUMENTS

| | | | |
|---|---|---|---|
| 451,938 | 5/1891 | Klapperich | 273/20 |
| 468,278 | 2/1892 | Serwood | 273/20 |
| 789,779 | 5/1905 | Wright | 273/20 |
| 1,018,229 | 2/1912 | Baker | 273/20 |
| 1,104,815 | 7/1914 | Michanek | 273/20 |
| 1,114,693 | 10/1914 | Hirst et al. | 273/20 |
| 1,127,832 | 2/1915 | Voigt | 224/251 |
| 1,270,775 | 7/1918 | Bianchi | 273/20 |
| 1,427,712 | 8/1922 | Bashore | 273/20 |
| 1,567,783 | 12/1925 | Best | 224/162 |
| 1,818,514 | 8/1931 | Whitaker | 224/162 |
| 2,489,464 | 11/1949 | Roland | 273/20 |
| 3,309,089 | 3/1967 | Doyle | 273/32 B |
| 4,350,457 | 9/1982 | Carnahan | 273/32 B |

FOREIGN PATENT DOCUMENTS

| | | | |
|---|---|---|---|
| 15688 | 3/1911 | Denmark | 24/3 M |
| 513109 | 10/1920 | France | 24/3 K |
| 214121 | 4/1924 | United Kingdom | 273/20 |

*Primary Examiner*—Theatrice Brown
*Attorney, Agent, or Firm*—Basile and Hanlon

[57] ABSTRACT

A billiard/pool cue chalk holder includes a spool rotatably mounted in a housing, A spring mounted in the housing biases the spool to a first normal position; while allowing rotation of the spool in an opposite direction by an external force. A flexible line is wound around the spool and has one end extending outward from the housing and connected to a cue chalk block receptacle in the form of a hollow cubical body having closed side walls, a bottom wall and an open front end spaced from the bottom wall. A connector is attached to the housing to releasably connect the housing and the cue chalk block receptacle to an article of clothing worn by a player.

9 Claims, 2 Drawing Sheets

PERSONAL CUE CHALK HOLDER

BACKGROUND OF THE INVENTION

1. Field of the Invention

This is a continuation of Ser. No. 07/898,310, filed Jun. 15, 1992.

The present invention relates, in general, to billiard-/pool cue chalk holders and, more specifically, to extensible and retractable billiard/pool cue chalk holders.

2. Description of the Art

Chalk is frequently applied to the tip of a billiard-/pool cue stick during the play of pool and billiards in order to increase the frictional contact between the tip of the cue stick and the cue ball so as to prevent slippage therebetween when the cue ball is struck by the cue stick. Cue chalk is typically available in the form of a small cube or block, three-quarters of an inch on a side. Paper is wrapped around all but one side of the chalk block. A hemispherical depression is initially formed in the uncovered end of the chalk block to receive the tip of a cue stick therein.

One or more chalk blocks are typically placed on the upper rails or ends of a billiard or pool table so as to be easily used by players during the play of a game. The physical location of the chalk blocks varies during the play of a game as each player will typically place the chalk block on the table at his particular location after he has completed applying chalk to the tip of his cue stick. The small size of the chalk blocks causes them to be easily knocked from the edge of the billiard or pool table onto the playing surface or, more frequently, onto the surrounding floor. In the latter instance, besides making the chalk blocks difficult to locate for subsequent use, the chalk blocks frequently break thereby rendering them useless for their intended purpose.

As a result, various cue chalk holders have been devised to physically retain chalk blocks in a fixed location, generally on the side of a billiard or pool table. Such holders take a variety of forms; but generally include an opening in a housing containing one or more chalk blocks which enables the tip of a cue stick to be inserted therethrough for applying chalk to the cue tip. Holders have also been devised which are extensible from a storage position on a billiard or pool table outward to a more convenient use application and automatically retractable back to the storage position. Some extensible and retractable chalk block holders have a chalk block receptacle mounted on an elongated string which passes around a spring-biased reel rotatably mounted in a housing attached to the billiard or pool table. The chalk block receptacle and string may be pulled outward from the holder for applying chalk to the tip of a cue stick and then released wherein the string and chalk block holder automatically retracts via the spring-biased reel toward the holder.

While such holders are effective in insuring that cue chalk is continually available on a billiard or pool table, such holders are mounted only in one or, at most, a few locations on the billiard or pool table and thus are not readily available at all positions around the perimeter of the billiard or pool table. Further, such holders require the user to be in close proximity to the pool table while applying chalk to a cue stick. This is inconvenient and may cause an interruption of play of another player if a billiard or pool player desires to apply chalk to his cue tip while awaiting the play of the other player.

It is also known to mount a magnet or a hook and loop-type fastener strip directly onto the side of a cue chalk block to enable the cue chalk block to be attached to a mating metal strip or hook and loop fastener which is clipped onto a player's clothing so as to enable a player to carry the cue chalk block directly on his or her person. However, such fasteners are relatively weak such that it is common for the cue chalk block to be easily dislodged from the player and lost.

Thus, it would be desirable to provide a billiard/pool cue chalk holder which overcomes the problems associated with previously devised cue chalk holders. It would also be desirable to provide a cue chalk holder which may be easily attached to the clothing of a billiard or pool player thereby enabling its ready use at any time. It would also be desirable to provide cue chalk holder which is readily attachable to the clothing of a player and which may be extended to a readily usable position to apply chalk to the tip of a cue stick. It would also be desirable to provide a cue chalk holder which is readily attachable to the clothing of a player and which may be automatically retracted into a small, compact, non-use, storage position. Finally, it would be desirable to provide a cue chalk holder which is securely attachable to the clothing of a player to prevent loss of the cue chalk.

SUMMARY OF THE INVENTION

The present invention is a billiard/pool cue chalk holder which is uniquely mountable on an article of clothing worn by a billiard or pool player thereby enabling cue chalk to be readily applied to the tip of a cue stick at any time regardless of the position of the player with respect to a billiard or pool table and without any inadvertent loss of the cue chalk.

The cue chalk holder of the present invention includes a housing having a first aperture formed in a side wall thereof. A spool is rotatably mounted in the housing. A flexible line has a first end fixedly attached to the spool and is wound in a plurality of turns around the spool. A receptacle having an open end, closed side walls and a bottom wall defining a hollow interior cavity is shaped to releasably receive a cue chalk block therein. The second end of the line extends outward through the first aperture in the housing and is fixedly attached to the receptacle. Biasing means are coupled between the spool and the housing for allowing rotation of the spool in one direction to extend the second end of the line outward from the housing and for normally biasing the spool in an opposite direction to normally retract the second end of the line toward the housing. Attachment means are attached to the housing for releasably attaching the housing and the cue chalk receptacle connected thereto to an article of clothing worn by a billiard or pool player.

In a preferred embodiment, the biasing means comprises a recoil spring having a first end fixedly and non-rotatably attached to an anchor shaft fixed within the housing and a second end coupled to the spool for biasing the spool to a normal position retracting the second end of the line toward the housing. The receptacle preferably comprises a body having four side walls, an integral bottom wall and an opposed open, front end spaced from the bottom wall and defining an internal cavity sized to removably receive a cue chalk block. A projection is formed on one of the side walls and has an end portion disposed at an angle with respect to the adjacent side wall and extending from the open end of the receptacle for securely mounting a chalk block in the receptacle while, at the same time, enabling the chalk block to be easily removed from the receptacle.

Means are formed on one side wall of the receptacle immediately adjacent the open end of the receptacle for connecting the second end of the line to the receptacle. The connecting means preferably comprises a flange formed on and extending outward from one side wall of the receptacle immediately adjacent the open front end of the receptacle. An aperture is formed in the flange for receiving the second end of the line therethrough which is knotted or otherwise fixedly secured to the receptacle. The aperture and flange are normally disposed adjacent the first aperture in the housing when the second end of the flexible line is substantially fully retracted into the housing to dispose the open end of the chalk block receptacle in a direction substantially facing the housing. The chalk block is thus oriented in a readily usable position when the chalk block receptacle is grasped by a user and pulled outward away from the housing. In this position, the open end of the receptacle is conveniently positioned to enable the tip of a cue stick to be inserted therein to apply cue chalk to the tip of the cue stick.

The connector means preferably includes a swivel retainer swivably mounted in and extending outward from one edge of the housing. The retainer may be directly connected to a suitable connector or indirectly through a connector ring to a connector which is releasably openable to attach the connector and the remainder of the cue chalk holder to an article of clothing, such as a belt loop, worn by a billiards or pool player.

The personal cue chalk holder of the present invention overcomes many of the problems associated with previously devised billiard/pool cue chalk holders. By uniquely enabling a cue chalk block to be carried by a billiards or pool player, the cue chalk is readily accessible at any time regardless of the position of the player with respect to a billiard or pool table. The cue chalk holder of the present invention is retractable to a small, compact shape so as not to interfere with the normal play of the player. At the same time, the receptacle carrying the cue chalk block may be extended to a readily accessible position to enable the player to apply cue chalk to the tip of his or her cue stick. Release of the cue chalk receptacle enables the recoil spring mounted in the housing of the cue chalk holder to retract the line and the cue chalk receptacle toward the housing. Finally, the holder of the present invention securely attaches the cue chalk to the player to minimize any inadvertent dislodgement and loss of the cue chalk.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
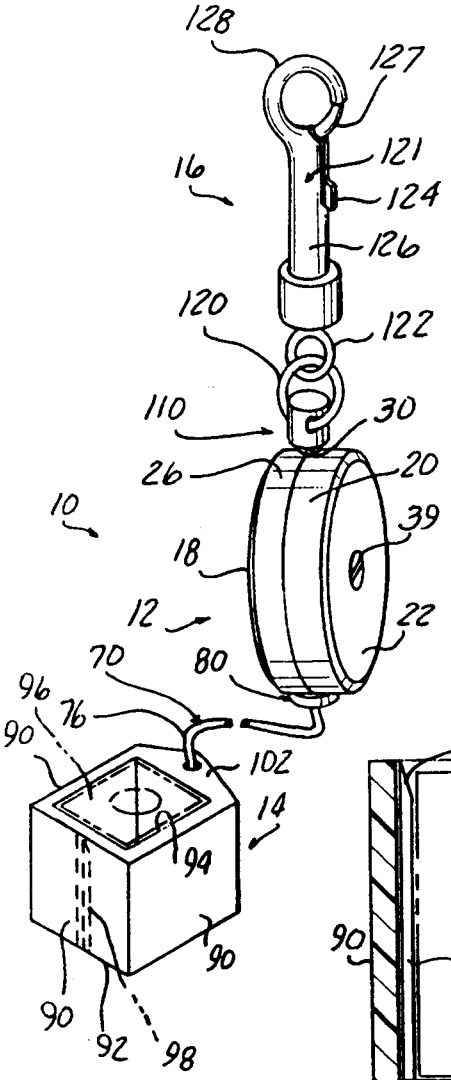
FIG. 1 is a perspective view of a cue chalk holder constructed in accordance with the teachings of the present invention, with the cue chalk block receptacle shown in a partially extended position.

Referring now to the drawing, and to FIG. 1 in particular, there is illustrated a personal cue chalk holder 10 constructed in accordance with the teachings of the present invention. Generally, the cue chalk holder 10 includes a housing 12, a cue chalk block receptacle 14 and an attachment means 16 for releasably attaching the housing 12 and the cue chalk block receptacle 14 to an article of clothing worn by a billiard or pool player.

Figure 4:
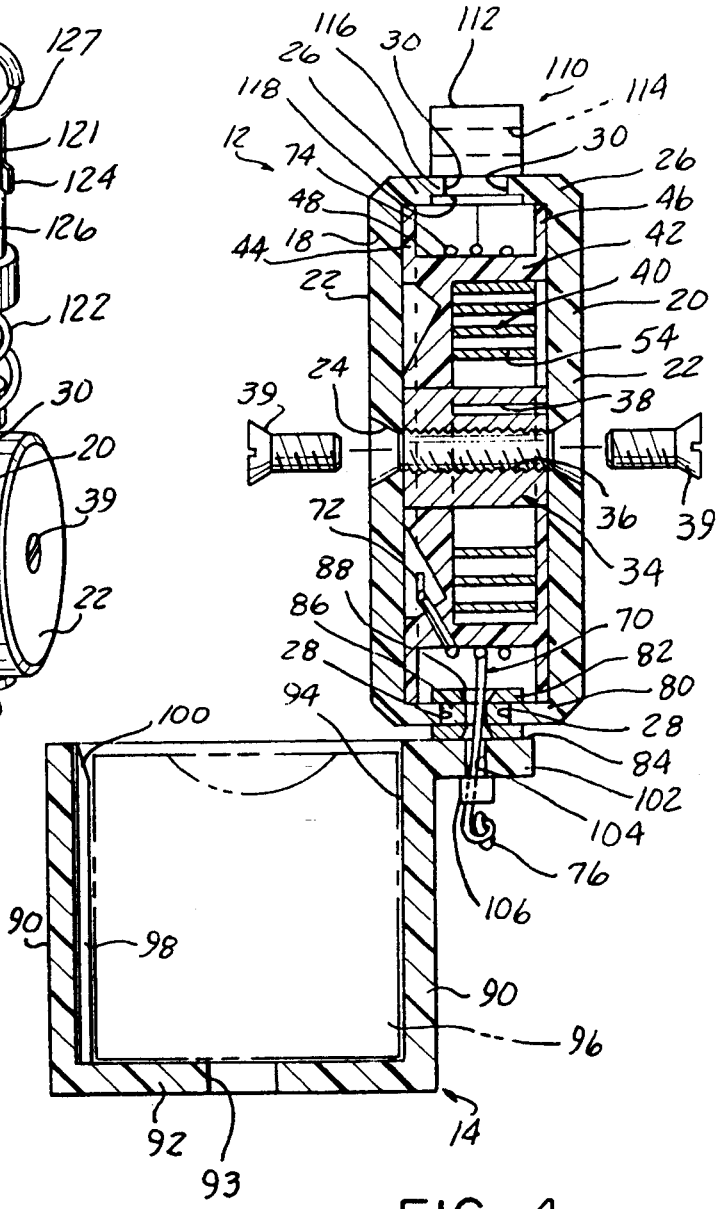
FIG. 4 is a partial cross sectional view through the housing and chalk block receptacle of the cue chalk holder shown in FIG. 1, with all of the components thereof shown in their assembled, retracted positions.
Figures 2, 3, 5:
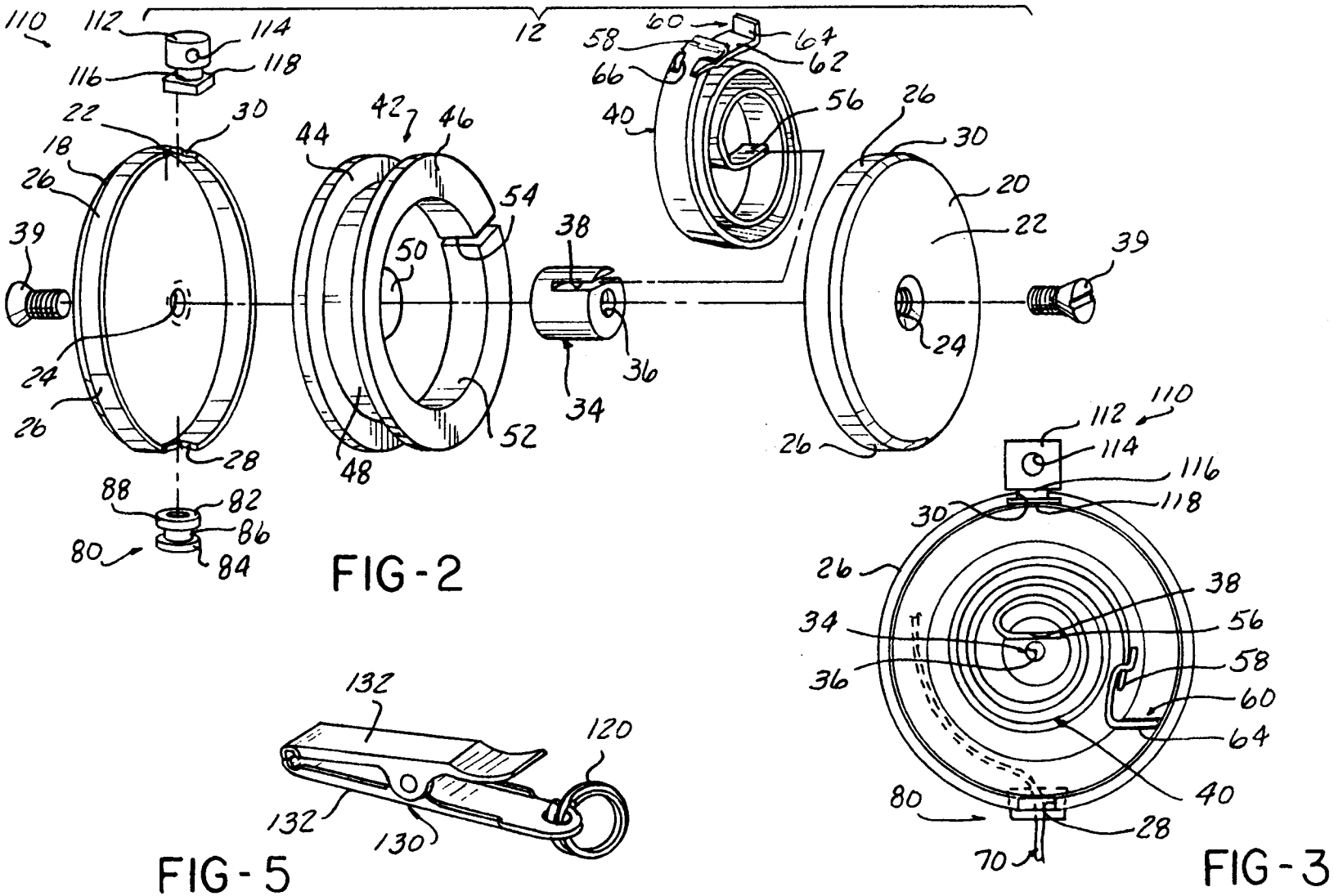
FIG. 2 is a partial, exploded, perspective view showing the components mounted in the housing of the cue chalk holder shown in FIG. 1.
FIG. 3 is a side elevational view of the housing of the cue chalk holder shown in FIG. 1, with one of the identical housing sections removed to show the internal components mounted within the housing.
FIG. 5 is a perspective view of another embodiment of an attachment connector used to attach the cue chalk holder to a player's clothing.

The housing 12, as shown in FIG. 1, and in detail in FIGS. 2–4 includes two identical housing sections or halves 18 and 20. Each housing section 18 and 20 is formed of a suitable, lightweight material, such as a plastic. By way of example only, an acrylic plastic is used to form each of the housing sections 18 and 20. As each of the housing sections 18 and 20 is identically constructed, the following description for the housing section 18 will be understood to apply equally to the construction and shape of the other housing section 20. As shown in FIG. 2, the housing section 18 includes a generally circular end wall 22 having a centrally located bore 24 formed therein. The bore 24 may be countersunk as shown in FIG. 2 by way of example only. A short annular side wall 26 is integrally formed with the end wall 22 and extends away from the end wall 22 for a short distance. A first generally semi-circular, open-ended aperture 28 is formed in the side wall 26 of the housing section 18. The aperture 28 mates with a similar semi-circular, open-ended aperture 28 in the housing section 20 when the two housing sections 18 and 20 are joined together to form a generally circular aperture, the purpose of which will be described in detail hereafter. A second generally semi-circular aperture 30 is also formed in the side wall of the housing section 18, generally 180° from the first semi-circular aperture 28. The second aperture 30 likewise forms a generally circular aperture with a similar aperture in the other housing section 20 when the two housing sections 18 and 20 are joined together.

An anchor shaft denoted in general by reference number 34 has a generally cylindrical shape and is mounted between the end walls 22 of the housing sections 18 and 20. The anchor shaft 34 has a through bore 36 extending centrally therethrough. The bore 36 is threaded to threadingly receive fasteners, such as screws 38, which extend through the bores 34 in the end walls 22 of each of the housing sections 18 and 20 to fixedly connect the housing sections 18 and 20 together into the complete housing 12. An open-ended slot 38 is also formed in the anchor shaft 34 and extends inward from one end of the anchor shaft 34. The slot 38 is designed to fixedly receive one end of a biasing means denoted generally by reference number 40 in FIGS. 2 and 3 and described in detail hereafter. The anchor shaft 34 is formed of any suitable material, such as aluminum or other metallic material.

The two housing sections 18 and 20, when joined together by the fasteners 39 and the anchor shaft 34 form an internal cavity in which a recoil spool denoted generally by reference number 42 is rotatably disposed. The spool 42 can be formed of any suitable material, preferably, a plastic, such as nylon. The spool 42 includes first and second annular, disk-like end walls 44 and 46 which are integrally joined to and have a larger diameter than a central annular wall portion 48. The end walls 44 and 46 and the central wall portion 48 are preferably integrally formed as a one-piece plastic molding. A through bore 50 is formed in the first end wall 44 and slidably receives the anchor shaft 34 therethrough to rotatably mount the recoil spring 42 about the anchor shaft 34 within the joined housing sections 18 and 20. An enlarged aperture 52 is formed in the second end wall 46 and opens to a hollow interior cavity bounded by the annular central wall portion 48 and the end wall 44. A through slot 54 is formed in the annular central wall portion 48, the purpose of which will be described in detail hereafter.

The biasing means 40 is preferably in the form of a coil spring having a first end 56 and an opposed second end 58. The coil spring 40 is loosely wound a plurality of turns about the first end 56 which is bent at a generally 90° angle with respect to the end of the adjacent turn of the spring 40.

The spring 40 is formed of any suitable material having resilient or spring-like characteristics, such as blue steel. The first end 56 of the biasing spring 40 is fixed within the slot 38 in the anchor shaft 34 to fixedly mount the first end 56 of the coil spring 40 about the anchor shaft 34 within the internal recess formed in the recoil spool 42. A necked-down region formed adjacent the second end 58 is slidably mounted in a spring anchor denoted in general by reference number 60 in FIGS. 2 and 3. The spring anchor 60 has a generally L-shape with an arcuate-shaped leg 62 having a slit extending inward from one end and opening into an enlarged, generally circular aperture 66. The second end of the spring 58 is urged through a slit and rotated to bring the necked-down portion adjacent the second end 58 of the spring 40 into engagement with the circular aperture 66 in the spring anchor 60 to secure the spring anchor 60 to the second end of the spring 58. The outer leg 64 of the spring anchor 60 is bent at a generally 90° angle with respect to the arcuate leg 62 of the spring anchor 60 and is slidably urged into the slot 54 in the central wall 48 of the recoil spool 42 to fixedly connect the biasing spring 40 and the spring anchor 60 to the recoil spool 42.

It will be seen that due to the loose coil of turns formed in the spring 40, the recoil spool 42 will be biased by the spring 40 to a normal, first position. However, force exerted on the recoil spool 42, as described hereafter, will enable the recoil spool 42 to rotate from the normal position in an opposite direction, such as counterclockwise in the orientation shown in FIGS. 2 and 3. Release of the force exerted on the recoil spool 42 will enable the spring 40 to rotate the recoil spool 42 back to its normal, first position.

As shown in FIG. 4, a flexible line 70 has a first end 72 fixedly connected to the recoil spool 42. In a preferred embodiment, and by way of example only, the first end 72 of the flexible line 70 passes through the central wall portion 48 and through a notch in the first end wall 44 of the recoil spool 42 and is knotted to securely attach the first end 72 of the line 70 to the recoil spool 42. The line 70 is then wound in a plurality of turns, shown by reference number 74 in FIG. 4, about the peripheral surface of the central wall portion 48 of the recoil spool 42. The second end 76 of the line 70 extends away from the recoil spool 42 and passes outward from the housing 12 through the aperture 28 to a connection with the cue chalk block receptacle 14, as described hereafter.

The flexible line 70 may be formed of any suitable material, such as nylon, cotton string, etc.

An eyelet 80, shown in FIGS. 2–4, has opposed, enlarged diameter end portions 82 and 84 integrally connected by a reduced diameter shaft 86. The shaft 86 is mounted in the apertures 28 formed in the side walls 26 of the housing sections 18 and 20, with the enlarged end portion 82 fixedly mounted between the side walls 26 of the joined housing sections 18 and 20. A bore 88 extends through the eyelet 80 to enable the second end 76 of the flexible line 70 to pass freely outward from the recoil spool 42 in the housing 12. The eyelet 80 may be formed of any suitable material, such as steel, etc.

As shown in FIGS. 1 and 4, the second end 76 of the flexible line 70 is connected to the chalk block receptacle 14. The receptacle 14 is in the form of a hollow body having four substantially square side walls 90, a back wall 92 having a central aperture 93 formed therein, and an open front end 94 spaced from and opposing the back wall 92. The receptacle 14 is formed of a molded material, such as rubber, neoprene, plastic, etc.

The side walls 90 and the back wall 92 cooperate to form an internal recess which slidably receives a conventional cue chalk block 96 therein. A ridge-like projection 98 is formed on one of the side walls 90, as shown in FIG. 4. The projection 98, extends inward from the open front end 94 to the back wall 92. An angular or inclined surface 100 is formed on the outer edge of the projection 98 adjacent the open front end 94 of the receptacle 14. The angular or inclined surface 100 serves to guide the chalk block 96 when it is slidably urged by a user into its secure position in the receptacle 14 as shown in FIG. 4. The projection member 98 then serves to releasably hold the chalk block 96 in the receptacle 14. The chalk block 96 may be easily removed from the receptacle 14 by outward finger force through the aperture 93 in the back wall 92.

Means are formed on one of the side walls 90 of the receptacle 14 immediately adjacent the open front end 94 of the receptacle 14 for connecting the second end 76 of the flexible line 70 to the receptacle 14. In a preferred embodiment, as shown in FIGS. 1 and 2, the connecting means comprises a flange 102 which may be integrally formed with the receptacle 14. The flange 102 may have any shape, such as the generally angular, peaked shape shown in FIG. 1. A bore 104 extends through the flange 102 and receives the second end 76 of the flexible line 70 therethrough. The second end 76 of the line 70 may be knotted, as shown in FIG. 4, to securely attach the flexible line 70 to the receptacle 14. An enlarged bead 106 may also be provided between the knot at the end of the flexible line 70 and the flange 102 to provide secure attachment of the second end 76 of the line 70 to the receptacle 14. As shown in FIGS. 1 and 2, the bore 104 and the flange 102 are normally positioned immediately adjacent the eyelet 80 when the flexible line 70 is fully retracted into the housing 12. This places the open end 94 of the chalk block receptacle 14 in a generally upward direction facing the housing 12. This places the open end of the chalk block 96 in a readily usable position when the receptacle 14 is extended away from the housing 12 to enable cue chalk to be easily applied to the tip of a cue stick inserted through the open end 94 of the receptacle 14 into contact with the cue chalk block 96 housed therein.

The cue chalk holder 10 of the present invention also includes attachment means 16 for releasably attaching the cue chalk holder 10 to an article of clothing worn by a user or billiard/pool player. The attachment means 16, as shown in an exemplary embodiment in FIG. 1, includes a swivel retainer 110 which is also depicted in greater detail in FIGS. 2–4. The retainer 110 is in the form of an enlarged cylindrical body 112 having a bore 114 extending therethrough. A smaller diameter shaft 116 extends from the cylindrical portion 112 and terminates in an elongated, generally rectangular leg 118. The leg 118 fits within the side walls 26 of the mating housing sections 18 and 20 when the housing sections 18 and 20 are joined together with the shaft 116 extending through the circular aperture formed by the semi-circular apertures 30 formed in each housing section 18 and 20. The enlarged cylindrical portion 112 is located outward from the side walls 26 of the joined housing sections 18 and 20. The retainer 110 may swivel with respect to the side walls 26 of the housing 12 about its longitudinal axis to enable the housing 12 to lay flat against the leg of a player when the holder 10 is attached to the player's clothing.

The retainer 110 may be directly connected to a suitable, releasably openable connector 121 or indirectly to the connector 121 via a circular connecting ring 120 as shown in FIG. 1. The ring 120, in an exemplary embodiment, is mounted through the bore 114 in the swivel retainer 110. In turn, the ring 120 is mounted through a rotatable ring 122 swivably mounted at one end of the conventional connector 121. As is well known, a spring-biased, manually movable button 124 mounted on the shaft 126 of the connector 121 operates to open a movable portion 127 of a circular end 128 at one end of the shaft 126 to enable the attachment of the end portion 128 to a suitable appendage on the clothing of a user or billiard/pool player, such as a belt loop. In this orientation, with the connector 121 attached to the belt loop of a user's pants, the housing 12 and the cue chalk block receptacle 14 extend downward from the connector 121 in a normal storage position.

It will be understood that other connectors, such as clothespin-like connectors 130 in FIG. 5, may also be connected to the swivel retainer 110 for releasable attachment of the cue chalk holder 10 to an article of clothing worn by a player. The connector 130 is attachable by the ring 120 to the swivel retainer 110. As is conventional, the connector 130 includes a pair of spring-biased jaws 132 which are releasably attachable to a portion of a player's clothing, such as a belt loop, pocket edge, etc. Further, the cue chalk holder 10 of the present invention may also be attached to a stationary surface, such as a wall or a billiard or pool table by the connector.

In use, the components of the cue chalk holder 10 of the present invention are assembled as described above. The connector 121 may then be employed to mount the holder 10 on the belt loop, for example, of a user's pants. In this manner, the cue chalk block receptacle 14 hangs downward from the connector 16 a short distance so as not to interfere with the movement of the player in playing a game of billiards or pool. When the player desires to apply chalk to the tip of his or her cue stick, he or she merely grasps the receptacle 14 and pulls the receptacle 14 in an outward direction from the housing 12 thereby pulling the flexible line 70 and rotating the spool 42 against the bias of the recoil spring 40. This outward movement continues until the cue chalk block 96 is positioned at a desired position to apply chalk to the cue tip of a cue stick which is inserted through the open end 94 in the receptacle 14 into contact with the cue chalk block 96. It will be understood that the receptacle 14, in addition to its outward movement from the housing 12 may also be pivoted upward from the side of a user to any position due to the swivel retainer 110 and the pivotal connector 16 used in the cue chalk holder 10.

When the player has applied the desired amount of chalk to the tip of his or her cue stick, the receptacle 14 can be released such that the spring 40 rotates the spool 42 to its normal, position thereby retracting the flexible line 70 into the housing 12 and bringing the receptacle 14 carrying the cue chalk block 96 into close proximity with the housing 12.

In summary, there has been disclosed a unique personal cue chalk holder which is uniquely attachable to and carried by a user. The cue chalk holder is simply constructed and is designed for retraction into a small non-use, storage position so as not to interfere with the player's movement during the play of a game of billiards or pool. At the same time, the cue chalk block receptacle of the cue chalk holder of the present invention may be extended outward from the housing of the cue chalk holder to a readily accessible position to enable chalk to be applied to the tip of a cue stick. When the desired amount of chalk has been applied to the tip of the cue stick, the receptacle may be released such that the holder automatically retracts the receptacle toward the housing and back into the compact, storage position. The cue chalk holder also securely attaches the cue chalk to the player's clothing to prevent any dislodgement of the cue chalk.

What is claimed is:

1. A cue chalk holder for mounting a cue chalk block on an article of clothing worn by a user comprising:

a housing, a first aperture formed in the housing;

a spool rotatably mounted in the housing;

a flexible line having first and second ends, the first end attached to the spool, the line normally wound in a plurality of turns around the spool;

a receptacle having a back wall from which a side wall extends, an outer edge of the side wall surrounding an open end which opposes the back wall, a hollow interior cavity formed between the outer edge, the side wall and the back wall shaped to releasably receive a cue chalk block therein;

the second end of the line extending through the first aperture in the housing;

a flange formed on the side wall of the receptacle immediately adjacent the outer edge of the side wall and having a planar portion extending planarly outward from the outer edge;

an aperture formed in the flange for receiving the second end of the line therethrough, the planar portion of the flange normally disposed in registry with the housing about the first aperture in the housing when the second end of the flexible line is fully retracted within the housing to dispose the open end of the receptacle in a direction substantially facing the housing;

biasing means, mounted in the housing and connected to the spool, for allowing rotation of the spool in a first direction to extend the second end of the line outward from the housing and for normally biasing the spool in an opposite direction to retract the second end of the line toward the housing; and attachment means, connected to the housing, for releasably attaching the housing to an article of clothing worn by a user.

2. The cue chalk holder of claim 1 wherein the biasing means comprises:

a shaft fixedly and non-movably mounted within the housing;

a spring having first and second ends and wound in a plurality of turns between the first and second ends;

a slot formed in the shaft and receiving the first end of the spring therein; and the spring wound in a plurality of turns about the shaft; and the second end of the spring being connected to the spool.

an aperture formed in the flange for receiving the second end of the line therethrough, the aperture and the flange normally disposed adjacent the first aperture in the housing when the second end of the flexible line is retracted toward the housing to dispose the open end of the receptacle in a direction substantially facing the housing.

3. The cue chalk holder of claim 1 wherein the attachment means comprises:

a second aperture formed in the housing substantially opposite from the first aperture;

a retainer member swivably mounted in the second aperture and extending outward from the housing through the second aperture; and a releasably openable connector coupled to the retainer member at one end and releasably attachable to clothing worn by a user at an opposite end.

4. The cue chalk holder of claim 12 further comprising:

means for movably connecting the attachment means to the housing to permit movement of the housing with respect to the attachment means.

5. A cue chalk holder for mounting a cue chalk block on an article of clothing worn by a user comprising:

a housing, a first aperture formed in the housing;

a spool rotatably mounted in the housing;

a flexible line having first and second ends, the first end attached to the spool, the line normally wound in a plurality of turns around the spool;

a receptacle having an open end and a hollow interior cavity shaped to releasably receive a cue chalk block therein;

the receptacle including a back wall from which at least four attached side walls extend, outer edges of side walls surrounding the open end which opposes the back wall;

a cue chalk block having a depth disposed in the receptacle;

the side walls having a length longer than the depth of a cue chalk block such that the outer edges of the side-walls opposite the back wall extend outward beyond an outer edge of a cue chalk block disposed in the receptacle;

an elongated projection for securing the cue chalk block in the receptacle formed on one of the side walls and projecting into the hollow interior cavity of the receptacle , the projection having a first end in proximity. to the back wall and a second end proximate to the open end of the receptacle, the projection running from the back wall toward the open end of the receptacle, the second end of the projection adjacent the open end of the receptacle being disposed at an inclined angle with respect to the adjacent side wall of the receptacle;

the second end of the line extending through the first aperture in the housing and attached to the receptacle;

biasing means, mounted in the housing and connected to the spool, for allowing rotation of the spool in a first direction to extend the second end of the line outward from the housing and for normally biasing the spool in an opposite direction to retract the second end of the line toward the housing; and attachment means, connected to the housing, for releasably attaching the housing to an article of clothing worn by a user.

6. A cue chalk holder for mounting a cue chalk block on an article of clothing worn by a user comprising:

a housing, a first aperture formed in the housing;

a spool rotatably mounted in the housing;

a flexible line having first and second ends, the first end attached to the spool, the line normally wound in a plurality of turns around the spool;

a receptacle having an open end and a hollow interior cavity shaped to releasably receive a cue chalk block therein;

a cue chalk block having a depth disposed in the receptacle;

the receptacle including a back wall from which at least four attached side walls extend, outer edges of the side walls surrounding and forming the open end which opposes the back wall, the side walls having a length longer than the depth of the cue chalk block such that the outer edges of the side walls opposite the back wall extend outward beyond an outer edge of the cue chalk block disposed in the receptacle;

the second end of the line extending through the first aperture in the housing;

biasing means, mounted in the housing and connected to the spool, for allowing rotation of the spool in a first direction to extend the second end of the line outward from the housing and for normally biasing the spool in an opposite direction to retract the second end of the line toward the housing;

means, formed on one side wall of the receptacle, immediately adjacent the open end of the receptacle, for connecting the second end of the line to the receptacle, the connecting means including a flange formed on one side wall of the receptacle immediately adjacent the open end of the receptacle and extending outward therefrom, an aperture formed in the flange for receiving the second end of the line therethrough, the aperture and the flange normally disposed adjacent the first aperture of the housing when the second end of the line is retracted toward the housing to dispose the open end of the receptacle in a direction substantially facing the housing;

an aperture formed in the back wall of the receptacle permitting user finger insertion therethrough to slidably elect the cue chalk block from the receptacle; and attachment means, connected to the housing, for releasably attaching the housing to an article of clothing worn by a user.

7. The cue chalk holder of claim 8 wherein the biasing means comprises:

a shaft fixedly and non-movably mounted within the housing;

a spring having first and second ends and wound in a plurality of turns between the first and second ends;

a slot formed in the shaft and receiving the first end of the spring therein; and the spring wound in a plurality of turns about the shaft; and the second end of the spring being connected to the spool.

8. The cue chalk holder of claim 8 wherein the attachment means comprises:

a second aperture formed in the housing substantially opposite from the first aperture;

a retainer member swivably mounted in the second aperture and extending outward from the housing through the second aperture; and a releasably openable connector coupled to the retainer member at one end and releasably attachable to clothing worn by a user at an opposite end.

9. A cue chalk holder for mounting a cue chalk block on an article of clothing worn by a user comprising:

a housing, a first aperture formed in the housing;

a spool rotatably mounted in the housing;

a flexible line having first and second ends, the first end attached to the spool, the line normally wound in a plurality of turns around the spool;

a receptacle having an open end and a hollow interior cavity shaped to releasably receive a cue chalk block therein;

a cue chalk block having a depth disposed in the receptacle;

the receptacle including a back wall from which at least four attached side walls extend, outer edges of the side walls surrounding and forming the open end which opposes the back wall, the side walls having a length longer than the depth of the cue chalk block such that the outer edges of the side walls opposite the back wall extend outward beyond an outer edge of the cue chalk block disposed in the receptacle; an elongated projection for securing the cue chalk block in the receptacle formed on one of the side walls in the hollow interior cavity of the receptacle which extends from the back wall toward the open end of the receptacle, an end of the projection adjacent the open end of the receptacle being disposed at an inclined angle with respect to an adjacent side wall of the receptacle;

the second end of the line extending through the first aperture in the housing;

biasing means, mounted in the housing and connected to the spool, for allowing rotation of the spool in a first direction to extend the second end of the line outward from the housing and for normally biasing the spool in an opposite direction to retract the second end of the line toward the housing; means end of the projection adjacent the open end of the receptacle being disposed at an inclined angle with respect to the adjacent side wall of the receptacle;

the second end of the line extending through the first aperture in the housing and attached to the receptacle;

biasing means, mounted in the housing and connected to the spool, for allowing rotation of the spool in a first direction to extend the second end of the line outward from the housing and for normally biasing the spool in an opposite direction to retract the second end of the line toward the housing; and attachment means, connected to the housing, for releasably attaching the housing to an article of clothing worn by a user.

means, formed on one side wall of the receptacle, immediately adjacent the open end of the receptacle, for connecting the second end of the line to the receptacle, the connecting means including a flange formed on one side wall of the receptacle immediately adjacent the open end of the receptacle and extending outward therefrom, an aperture formed in the flange for receiving the second end of the line therethrough, the aperture and the flange normally disposed adjacent the first aperture of the housing when the second end of the line in retracted toward the housing to dispose the open end of the receptacle in a direction substantially facing the housing; and attachment means, connected to the housing, for releasably attaching the housing to an article of clothing worn by a user.

* * * * *